US009546473B2

(12) United States Patent
Cronje et al.

(10) Patent No.: US 9,546,473 B2
(45) Date of Patent: Jan. 17, 2017

(54) PLUMBING CONNECTION HUB

(75) Inventors: Louise Cronje, Pretoria (ZA); Johannes Cronje, Pretoria (ZA); Pieter Albertus Reinecke, Pretoria (ZA)

(73) Assignee: Pieter Albertus Reinecke, Pretoria (ZA)

( * ) Notice: Subject to any disclaimer, the term of this patent is extended or adjusted under 35 U.S.C. 154(b) by 1000 days.

(21) Appl. No.: 12/933,354

(22) PCT Filed: Jul. 31, 2008

(86) PCT No.: PCT/ZA2008/000069
§ 371 (c)(1),
(2), (4) Date: Sep. 17, 2010

(87) PCT Pub. No.: WO2009/094676
PCT Pub. Date: Jul. 30, 2009

(65) Prior Publication Data
US 2011/0115215 A1 May 19, 2011

(30) Foreign Application Priority Data
Jan. 23, 2008 (WO) ..... PCT/ZA2008/000005

(51) Int. Cl.
*E03C 1/02* (2006.01)
*E03C 1/284* (2006.01)

(52) U.S. Cl.
CPC ..... *E03C 1/021* (2013.01); *E03C 1/284* (2013.01)

(58) Field of Classification Search
CPC ..... E03C 1/14; E03C 1/16; E03C 1/182; E03C 1/184; E03C 1/284; E03C 1/32; E03C 1/021
USPC ..... 285/30, 56, 61, 64
See application file for complete search history.

(56) References Cited

U.S. PATENT DOCUMENTS

| | | | | |
|---|---|---|---|---|
| 4,410,004 | A | 10/1983 | Kifer et al. | |
| 4,637,422 | A | 1/1987 | Izzi, Sr. | |
| 4,654,900 | A * | 4/1987 | McGhee | 4/670 |
| 5,423,345 | A * | 6/1995 | Condon et al. | 137/360 |
| 5,558,119 | A * | 9/1996 | Condon et al. | 137/360 |
| 6,035,886 | A * | 3/2000 | Kerr | 137/360 |
| 6,234,193 | B1 * | 5/2001 | Hobbs et al. | 137/360 |
| 7,204,267 | B1 | 4/2007 | Persico | |

FOREIGN PATENT DOCUMENTS

| | | | |
|---|---|---|---|
| DE | 2745843 | A1 | 4/1979 |
| FR | 2598163 | A1 * | 11/1987 |
| WO | WO2007/038809 | | 4/2007 |

* cited by examiner

*Primary Examiner* — James Hewitt

(57) ABSTRACT

A plumbing connection hub for connecting household plumbing to appliances or basins is provided. The hub includes a container formed by a continuous wall and at least one open side, a tubular drain outlet leading out of the container through an operatively lower portion of the wall and the outlet being connectable to the sewage system of a house, and a drain inlet leading into the container from an open side with the tube fixed to the wall, and with the inner ends of the inlet and outlet positioned to receive a s-trap between them. The hub further includes a water connection elbow pipe locator for locating a water connection elbow pipe.

13 Claims, 10 Drawing Sheets

SECTION A-A
SCALE 1:2

PLUMBING CONNECTION HUB

TECHNICAL FIELD OF THE INVENTION

This invention relates to a hub for plumbing. More particularly, it relates to a hub for connecting the plumbing connections of basins and appliances such as a dishwasher or washing machine to the plumbing connections of a home.

BACKGROUND TO THE INVENTION

The applicant is aware that the plumbing connections of baths, wash basins and appliances such as dishwashers and washing machines normally need to be connected to municipal water system of a house and to a sewage system of a house. These connections of a house are usually solely functional, low cost and not aesthetically pleasing. These connections are usually visible especially if the appliance is not connected. The connections may sometimes also be out of reach of the piping of the appliance. The applicant is further aware of DE 2745843, which discloses a box shaped plumbing hub having holes for piping and an integrally moulded s-trap. This s-trap, however has right angled corners which collect dirt. The s-trap is also covered by a lid rather than an inspection hole, which may cause leaks. The applicant made a similar invention in PCT/ZA06/00110, with an integrally formed s trap in the form of an integrally formed pipe. However, the applicant found this to be excessively expensive to manufacture by means of moulding. The use of the known plumbing connection hubs and other plumbing connection hubs as described in U.S. Pat. No. 4,637,422 and U.S. Pat. No. 4,410,004 are limited to specific uses, and the US patents further does not provide for an s-trap. It is an object of this invention to provide a versatile, cost effective, convenient and aesthetically pleasing means for connecting such appliances, basins and baths.

It is an object of this invention to provide an improved plumbing hub which can be used for any household plumbing application.

GENERAL DESCRIPTION OF THE INVENTION

According to a first aspect of the invention there is provided a plumbing connection hub, which hub includes:

a container formed by a continuous wall and at least one open side;

a tubular drain outlet leading out of the container through an operatively lower portion of the wall and the outlet being connectable to the sewage system of a house;

a drain inlet leading into the container from an open side with the tube fixed to the wall, and with the inner ends of the inlet and outlet positioned and configured to receive a s-trap between them; and a water connection elbow pipe locating means for locating a water connection elbow pipe.

It will be appreciated that an s-trap normally of rubber may be an off the shelf low cost s-trap used for normal plumbing connections. The ends of the s-trap can be easily clamped onto the inner ends of the drain inlet and outlet.

An elbow pipe will be understood to mean piping with an approximately 90 degrees bend.

The container may, alternatively, have two opposed open sides and the inlet may be a T-shaped tubular inlet.

It will be appreciated that the T-shaped tubular drain inlet leading into the container allows a drain outlet of an appliance or basin to be connected from either open side of the container with the non connected end of the T shaped tubing sealed with a cap or plug.

In the case where the container only has one open side, the inlet may be elbow shaped or straight.

The inlet and outlet of the container may be generally vertically aligned, in use, to allow the use of a looped flexible hose to be used to function as an s-trap. It will be appreciated that, apart from a cost saving of using suitable flexible hose instead of an s-trap, the design in this case allows a water connection elbow pipe locating means on each side of the inlet and outlet to allow connection to a basin with two taps to be connected without bending or crossing any of the water supply pipes or drain pipe for ease of installation and to provide an aesthetically pleasing balanced look.

In the case where the container only has one open side, the container will include a back wall integrally formed with the side walls. The back wall may then be provided with inspection openings for inspecting and/or maintaining the inlet and/or outlet.

In the case where the container only has one open side, the plumbing connection hub may include a further inlet leading into the container through the back wall.

It will be appreciated that the further inlet allows all the connections to be made from the other side of the wall to the basin or appliance.

The plumbing connection hub may include a plug or cap for sealing one of the opposed ends of the T-shaped tubular drain inlets or any unused inlet, in use.

The plumbing connection hub may include a back plate for covering the non used open side, in use.

The water connection elbow pipe locating means for locating a water connection elbow pipe leading into the container may be in the form of a channel in the container with one end of the pipe extending through a hole defined in the wall of the container and the other end extending towards an open side.

In another embodiment of the invention, the water connection elbow pipe locating means for locating a water connection elbow pipe may be in the form of an open channel defined in the wall of the container with one end of the pipe extending away from the wall and the other end extending towards an open side of the container.

It will further be appreciated that water connection elbow pipe locating means is a formation for locating a plumbing pipe elbow available off the shelf and the locating means provides versatility in the sense that one side of the elbow can extend to either open side of the container. The elbow does not form part of the invention.

It will further be appreciated that the two open sides which can be selectively covered with a cover plate allows the hub to be accessed from either side such as from an outside of a wall into which the hub is built.

With regard to the water connection elbow pipe location means, the end extending towards the open side, in use, is connectable to a water intake of an appliance or tap of a basin and the end extending through the hole defined in a wall of the container is connectable to the household water supply of a house.

The drain inlet and drain outlet may preferably be integrally formed with the container.

The water connection elbow pipe location means may preferably be integrally formed with the container.

The container is dimensioned to the in the size of one or more standard brick units to be built into a wall or form part of a wall without disturbing the structural integrity of the wall. The end of the connection elbow pipe extending through a hole would then be connected to plumbing inside the wall, when finished. The dimensions of the hub may preferably correspond to that of two standard sized bricks.

The drain outlet leading out of the container may lead to an operatively bottom wall of the container to be connected to a sewage system of a house in a wall when installed.

The hub may include two water connection elbow pipe location means, one water connection may be for cold water and the other water connection for warm water. The hub may include an indication means for indicating which water connection is for cold water and which water connection is for warm water.

The water connections may be provided with valves or stoppers in order to close the connections when the connections are not in use.

The drain inlet may extend to the outside of the container and may be provided with thread for attachment to a complementary threaded drain outlet piping from an appliance or a basin.

The operatively bottom part of the S-trap may be provided with a closable inspection hole.

The middle portion of the S-trap piping may be provided with a widening portion. The widening portion acts as a buffer for high outflow of drainage water.

The container may include a brace for fixing the drain inlet tube to the container. The brace and inlet may preferably be integrally formed with the container.

The water connection elbow pipe location means may be complementary cross-sectionally u-shaped channels integrally formed with the container wherein the connection elbow fits, in use.

The u-shaped channels may extend along the width of the sidewall to allow elbow pipe connections from either side of the container and the elbow pipe location means may then include a stopper formation in the channel to respectively locate a front or rear connected elbow pipe.

It will be appreciated that off the shelf plumbing elbow piping can be glued into position in the location means with glue such as epoxy.

The open-sided container may be provided with a first lid with holes defined therein for receiving the piping or connections there through and a second lid with no holes for closing the other open end through which no piping extends, in use. The lid may be dimensioned to be longer and wider than the open side of the container to hide plastering imperfections, in use.

The hub may include locating formations extending transversely from the operatively front part of side walls of the container for locating the hub at a predetermined depth in a wall.

The lid and/or side walls may include gripping formations formed thereon for gripping cement when built into a wall.

The lid and container of the hub may include complementary holes for receiving screws for attaching the lid to the container. It will be appreciated that the lid can be screwed to the container until the lid is stopped by plaster or the edge of the side walls. It will be appreciated that the lid can be unscrewed and slid along the connected piping to provide access to the inspection hole in the S-trap.

It will be appreciated that the container of the hub can be installed countersunk in a wall of a house with its connections connected to the corresponding connections of the house on the outside of the container and with the open side of the container providing access to the inspection hole. The drain, S-trap and tap fittings are hidden from view, in use, to provide an easy to install, convenient and aesthetically pleasing plumbing connection hub.

DETAILED DESCRIPTION OF THE INVENTION

The invention is now described by way of example with reference to the accompanying drawings.

Figure 1:
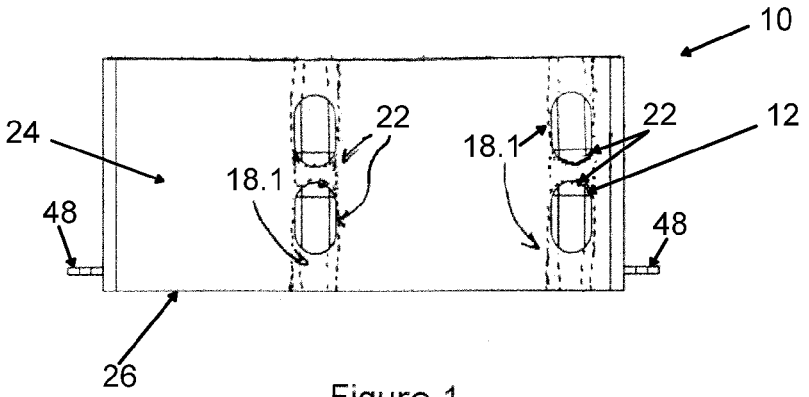
FIG. 1 shows a top view of a plumbing connection hub, in accordance with the invention.
Figure 2:
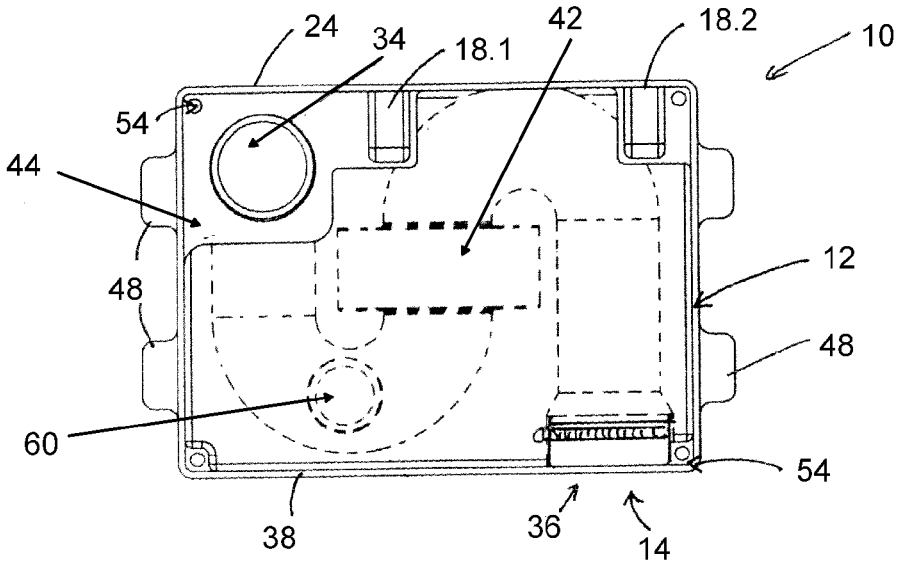
FIG. 2 shows a plan view of the plumbing connection hub.
Figure 3:
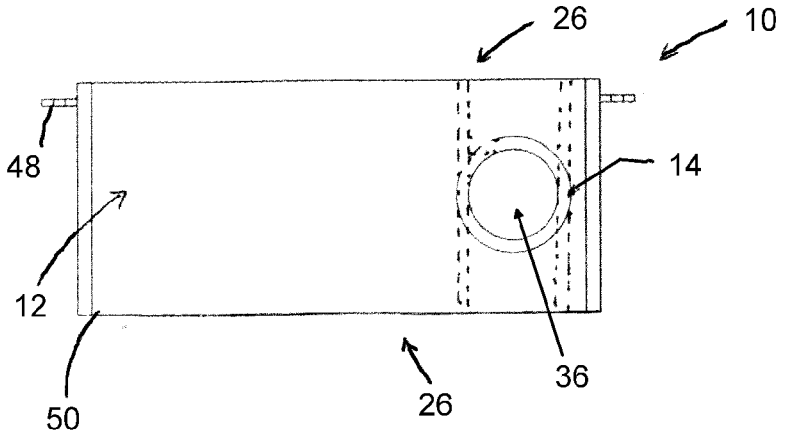
FIG. 3 shows a bottom view of the plumbing connection hub.
Figure 4:
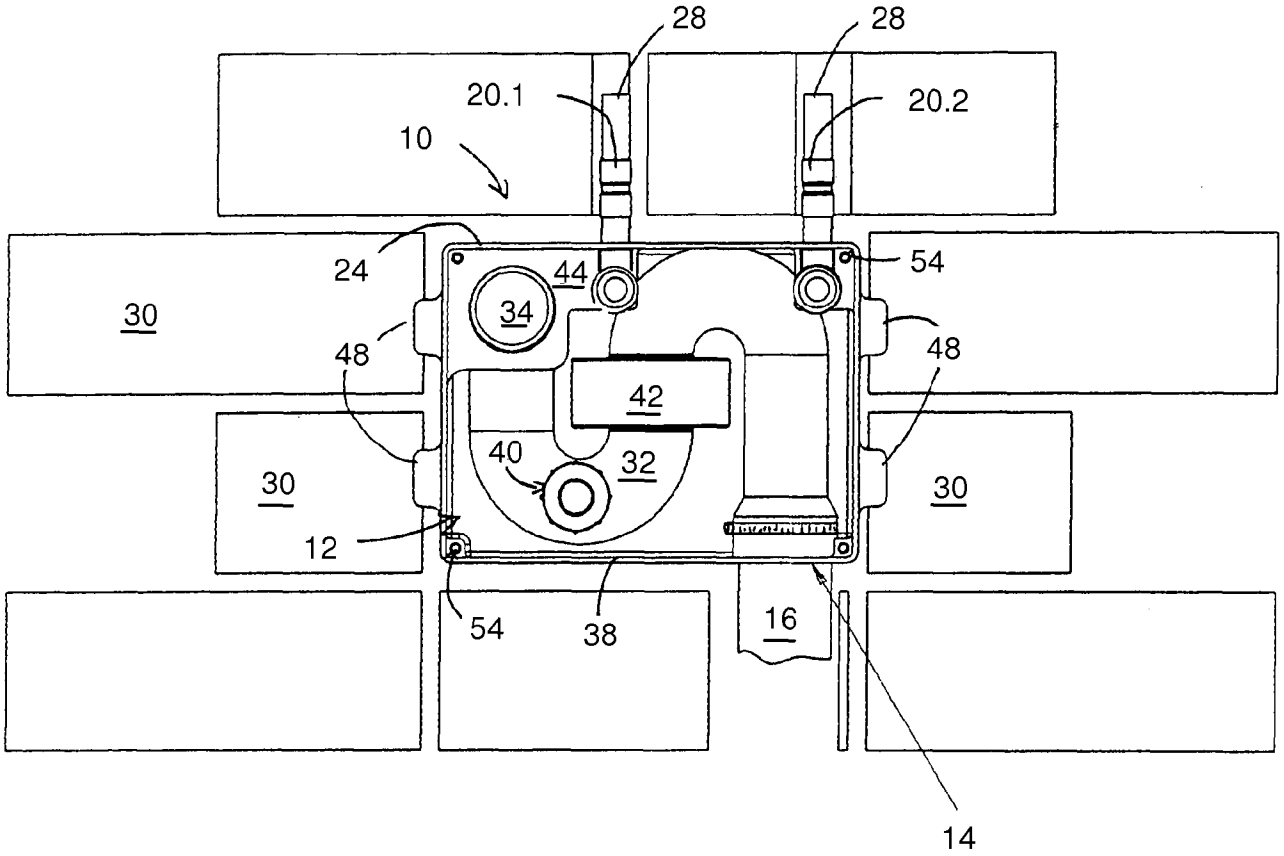
FIG. 4 shows a front plan view of the plumbing connection hub partly installed.
Figure 5:
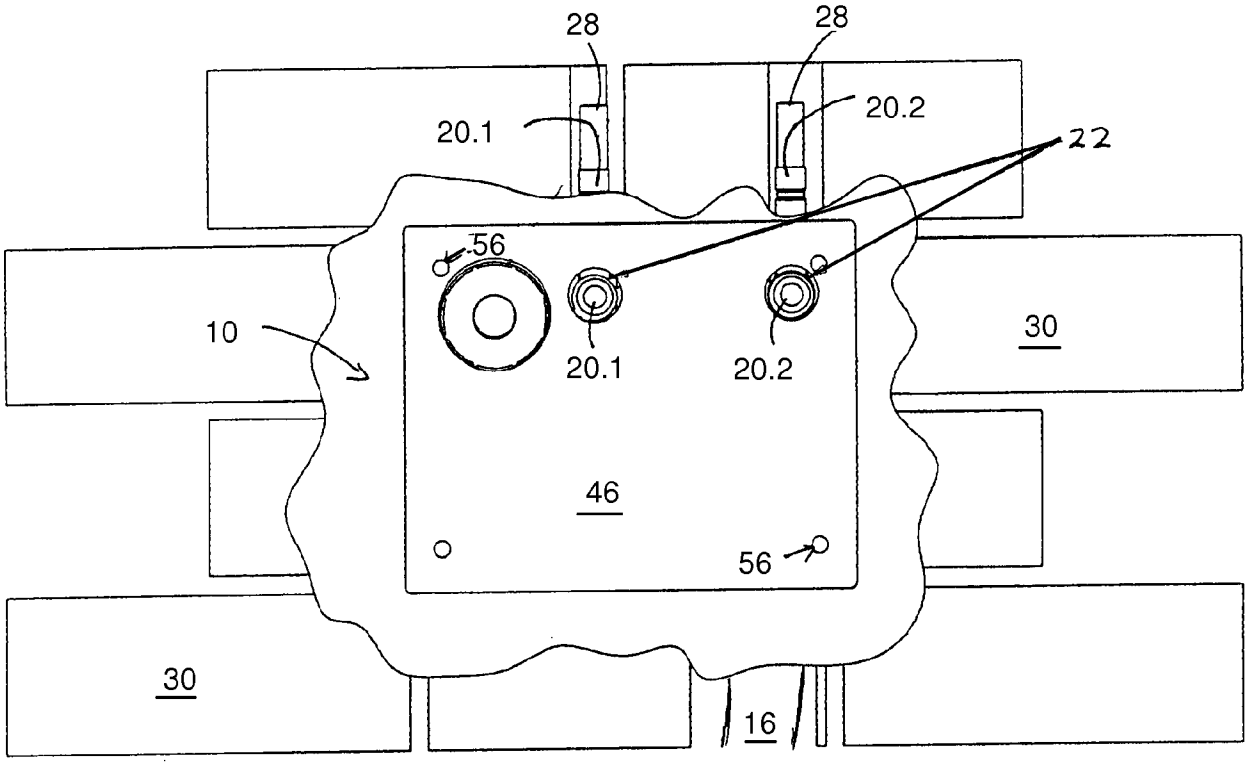
FIG. 5 shows a plan view of the plumbing connection hub fully installed

Referring now to the drawings, FIGS. 1 to 5, the plumbing connection hub, in accordance with the invention, is generally indicated by reference numeral 10. The plumbing connection hub 10, includes a container 12 formed by a continuous wall 24 and having two opposed open sides 26; a tubular drain outlet 14 leading out of the container through an operatively lower portion of the wall 24 and the outlet being connectable to the sewage system of a house; and a T-shaped tubular drain inlet 34 leading into the container from the open sides with the tube fixed to the wall 24, and with the inner ends of the inlet and outlet positioned to receive a s-trap between them.

The hub 10 further includes a pair of water connection elbow pipe location means 18 in the form of cross-sectionally u-shaped channels for locating a hot and cold water connection elbow pipe 20 inside the container with one end of the pipe extending through a hole 22 defined in a wall 24 of the container 12 and the other end extending through one of the open sides 26, the operatively front side. The end of the pipe 20 extending through the open side 26 is connectable to a water intake of an appliance or tap of a basin and the end extending through the hole 22 defined in a wall 24 of the container 12 is connectable to the household water supply 28 of a house outside the container 12. The container 10 is dimensioned and configured to be built into a wall in the space of two standard bricks 30.

The hub 10 also includes drain piping 32 fitted with a removable rubber S-trap clamped to the inlet and outlet to prevent sewage odours from escaping past the drain outlet. The S-trap piping is located inside the container 12 with one end, the inlet 34, leading to an operatively upper part of the open side 26 of the container and the other end, the outlet 36, leading to an operatively bottom wall 38 of the container.

The inlet 24 is provided with thread for attachment to a complementary threaded drain outlet piping from an appliance or a basin. The operatively bottom part of the S-trap is provided with a closable inspection hole 40. The middle portion of the S-trap piping 32 may be provided with a widening portion 42. The widening portion 42 acts as a buffer for high outflow of drainage water.

The container 12 includes a brace 44 for supporting the inlet 34 end of the piping, leading to an operatively upper part of the open side of the container. The brace 44 is integrally formed with the container 12.

The water connection elbow pipe location means 18 are u-shaped channels integrally formed with the container 12 and extending across the container 12.

The open-sided container 12 is provided with a lid 46 with holes defined therein for receiving the piping or connections there through. The lid 46 is dimensioned to be longer and wider than the container 12 to hide plastering imperfections, in use.

The hub 10 further includes locating formations 48 extending transversely from the operatively front part of side walls of the container 12 for locating the hub at a predetermined depth in a wall. Alternatively, there can be pairs of locating formations and it can be removable to remove the formations on the operatively back side of the container.

The hub further includes a back plate for covering the open side of operatively back side of the container 12.

The back plate includes gripping formations formed thereon for gripping cement when built into a wall.

The lid 46 and container 12 of the hub 10 includes complementary holes 54 and 56 for receiving screws for attaching the lid to the container to allow the lid to be crewed to the container until the lid is stopped by plaster or the edge of the side walls.

Figure 6:
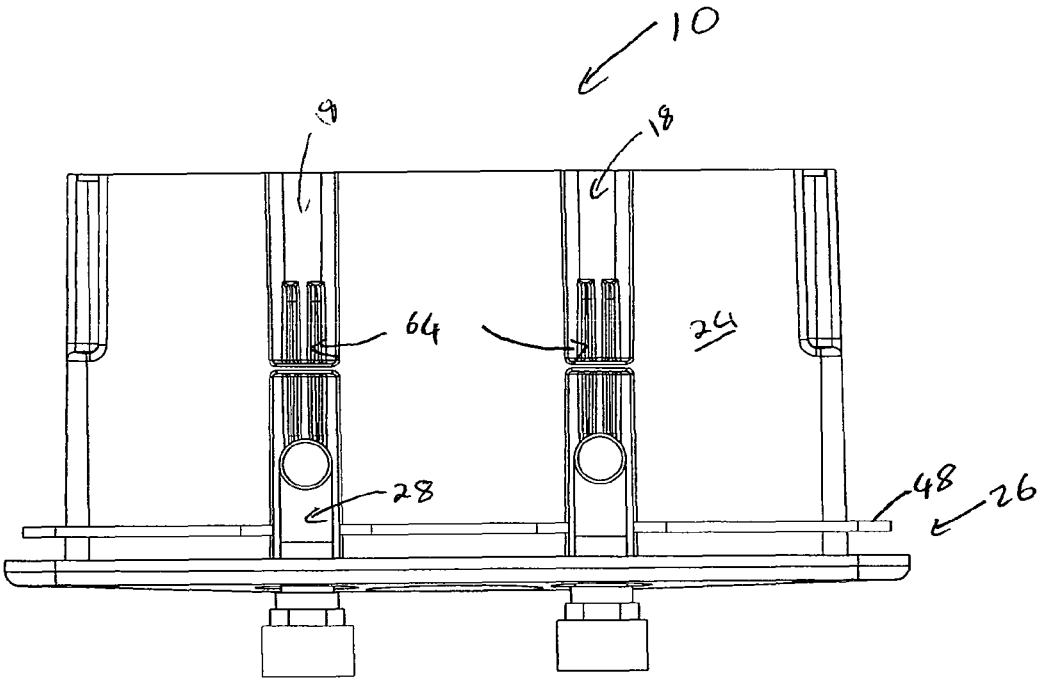
FIG. 6 shows a top view of a further, preferred embodiment, of a plumbing connection hub, in accordance with the invention.
Figure 7:
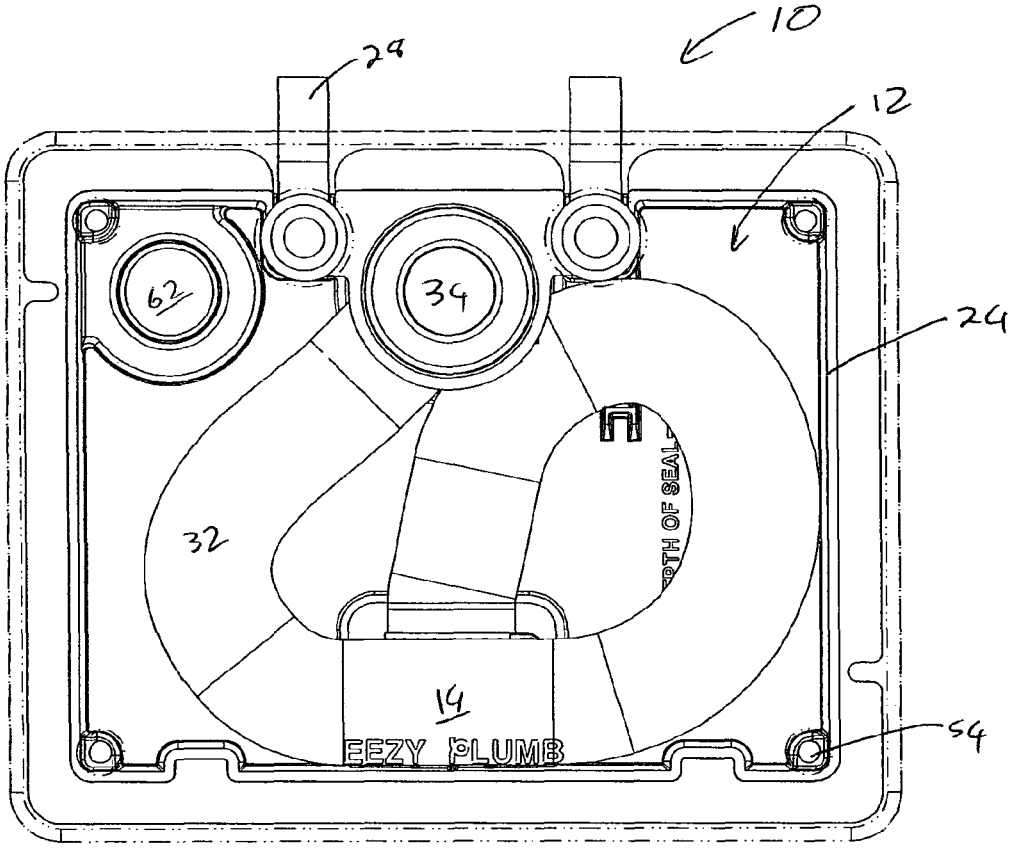
FIG. 7 shows a plan view of the preferred plumbing connection hub, without a lid.
Figure 8:
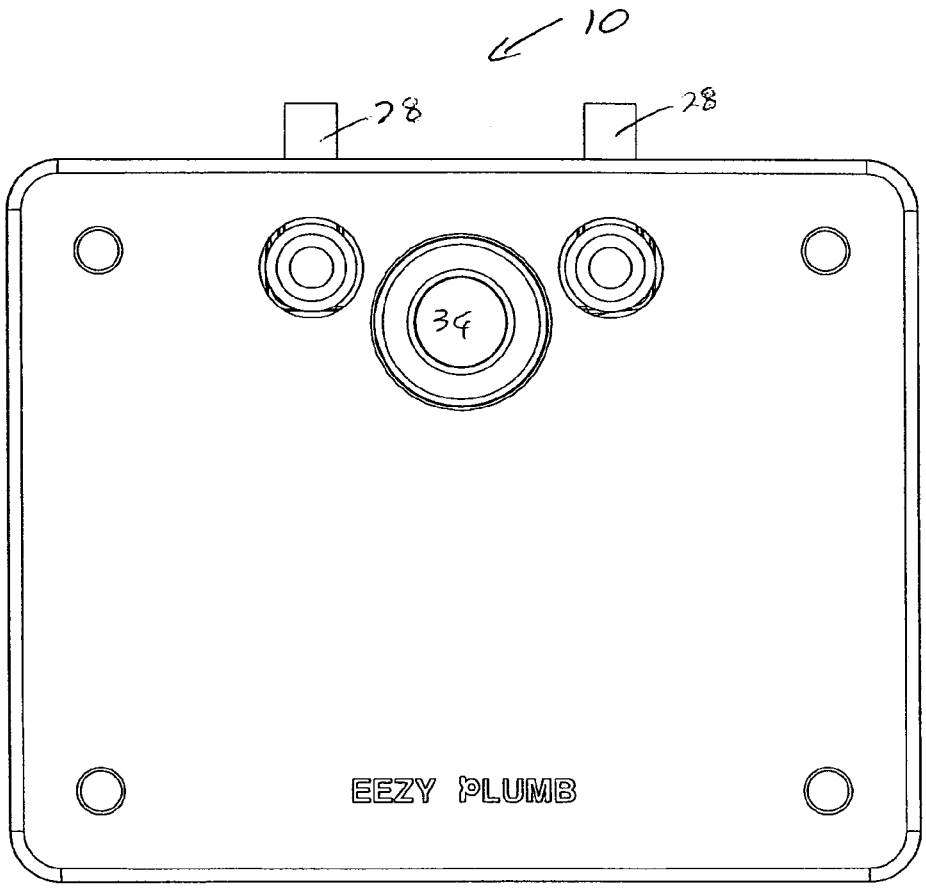
FIG. 8 shows a plan view of the preferred plumbing connection hub, without a lid.
Figure 9:
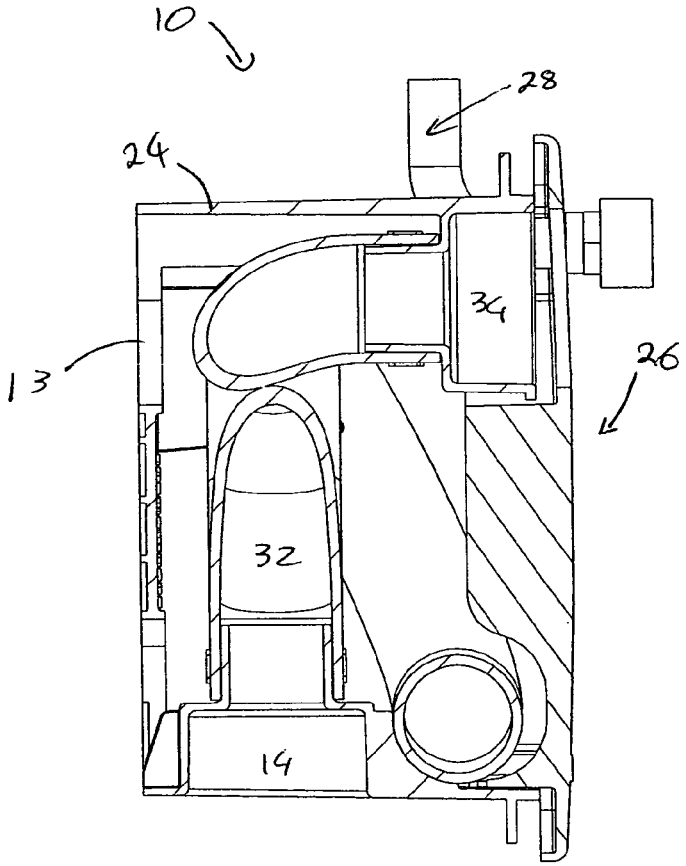
FIG. 9 shows a sectional side view of the preferred plumbing connection hub.
Figure 10:
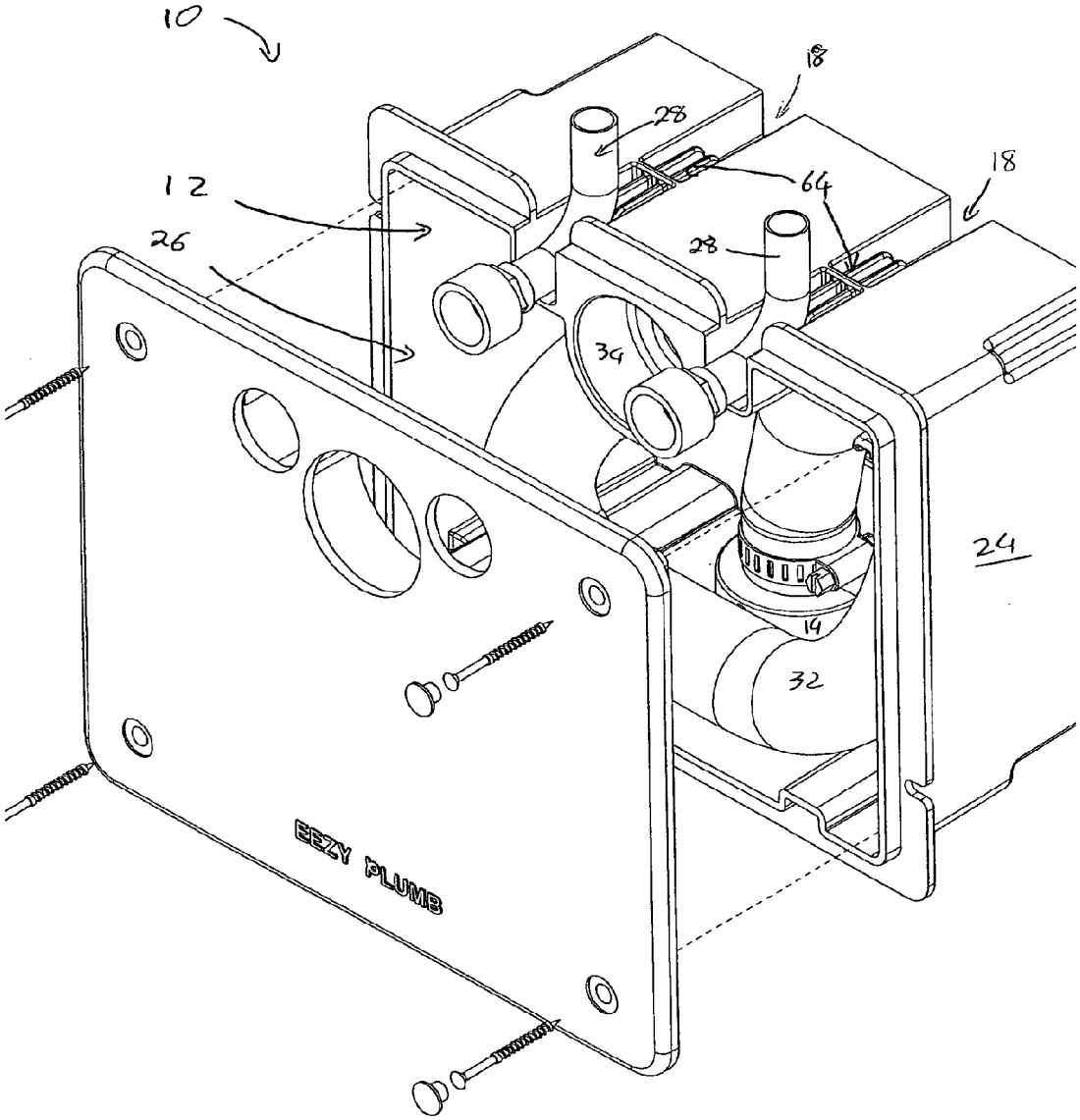
FIG. 10 shows an expanded front perspective view of the preferred plumbing connection hub.
Figure 11:
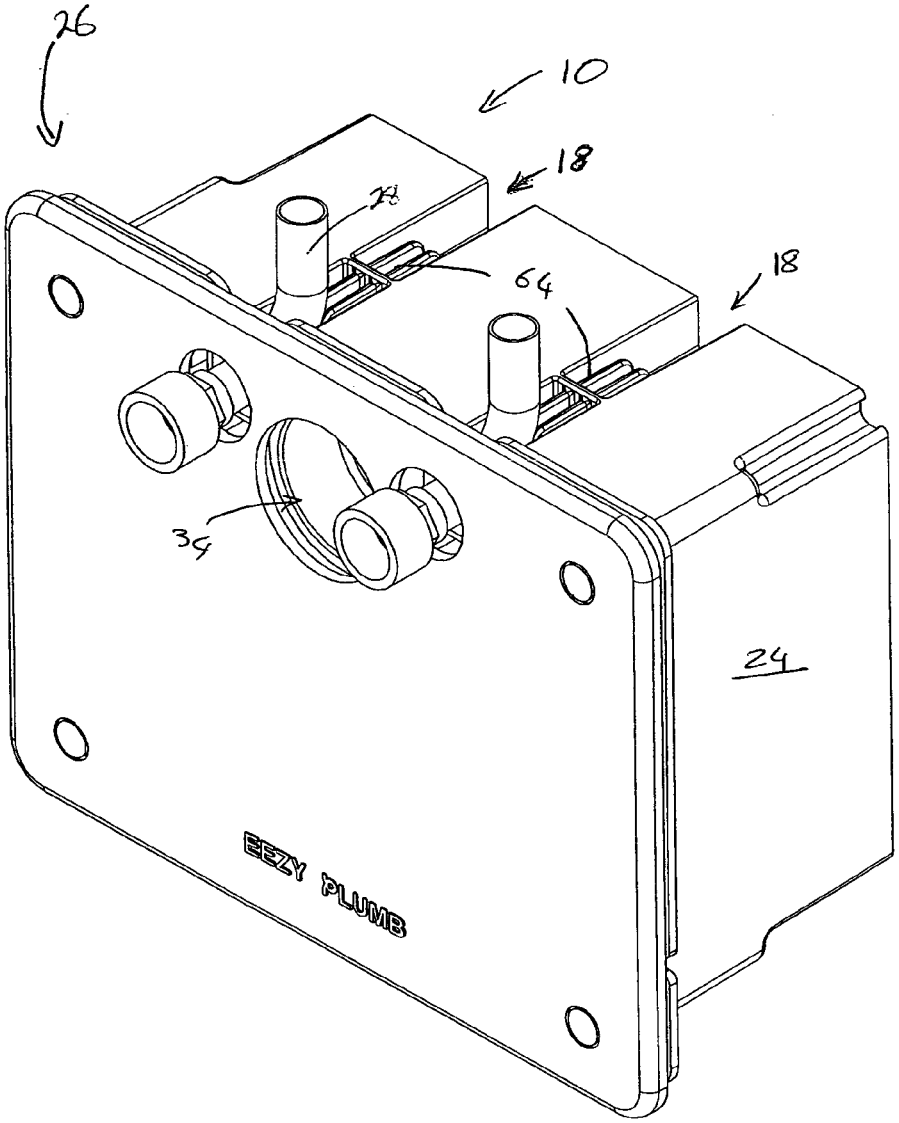
FIG. 11 shows a front perspective view of the preferred plumbing connection hub.
Figure 12:
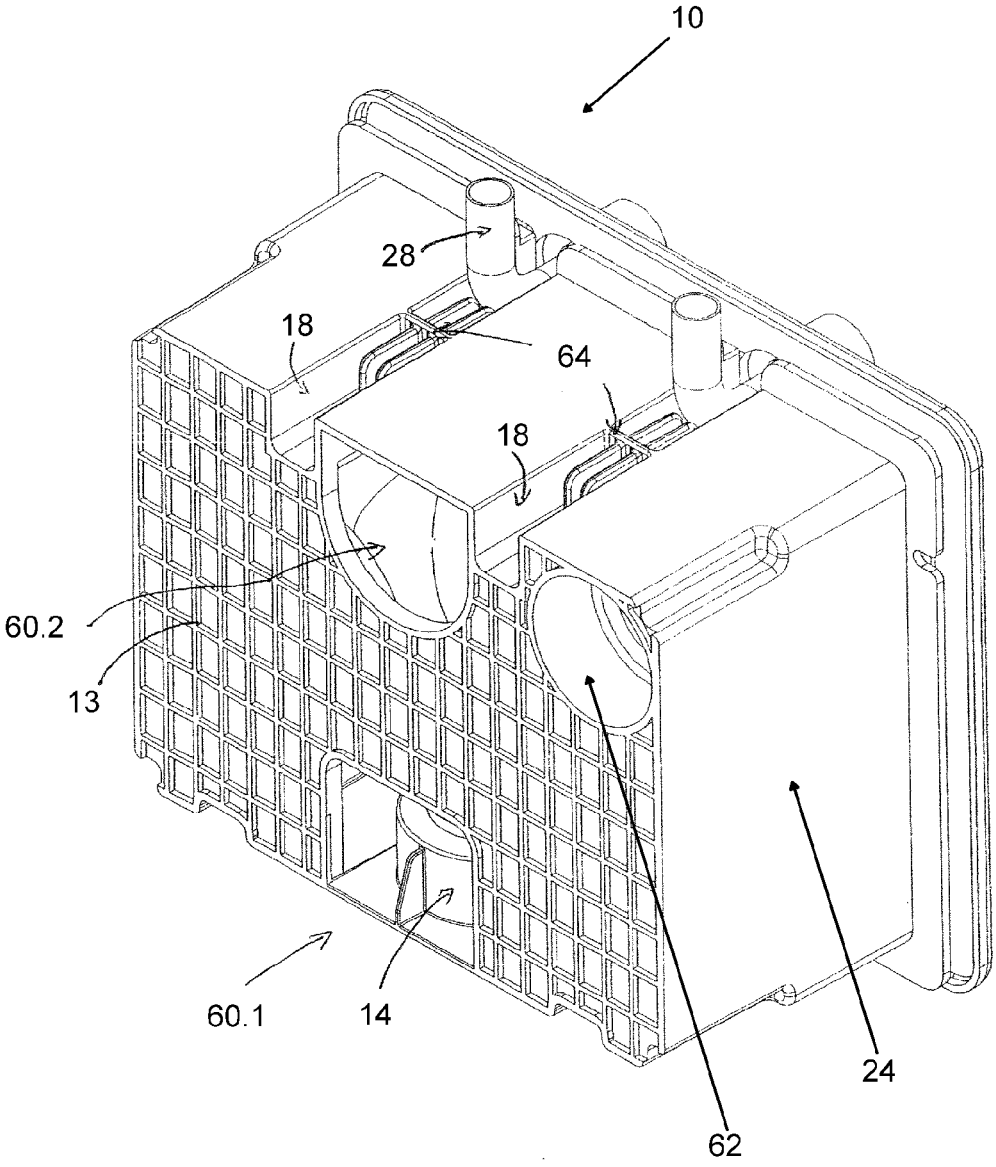
FIG. 12 shows a rear perspective view of the preferred plumbing connection hub.

Referring now to the drawings, FIGS. 6 to 12, the plumbing connection hub, in this embodiment in accordance with the invention, is generally indicated by reference numeral 10. The plumbing connection hub 10, includes a container 12 formed by a continuous wall 24 and having one rear wall 13 with one open side 26; a tubular drain outlet 14 leading out of the container through an operatively lower portion of the wall 24 and the outlet being connectable to the sewage system of a house; and a straight tubular drain inlet 34 leading into the container from the open side with the tube fixed to the wall 24, and with the inner ends of the inlet and outlet positioned vertically in-line to receive a looped flexible hose 32 to function as a s-trap between them.

The back wall 13 is provided with inspection openings 60.1 to the inlet 34 and 60.2 to the outlet 14 for inspecting and/or maintaining the inlet and/or outlet.

The plumbing connection hub 10 also includes a further inlet 62 leading into the container through the back wall 13.

The u-shaped channels 18 are open topped and extend along the width of the sidewall 24 to allow elbow pipe connections from either side of the container 12. The elbow pipe location means includes a stopper formation 64 in each channel to respectively locate a front or rear connected elbow pipe.

In use, a person would build the hub 10 into a wall and install elbow connections and connect them to a house water supply piping chased into the wall. The open end of the elbow connections will then be sealed before the water pressure is turned on. The drain pipe is connected to the sewerage piping of the house, also chased into the wall and the open end is sealed with a screw on cap. The wall is then plastered and the lid screwed on. When needed the hub can be connected to a basin or an appliance.

It shall be understood that the examples are provided for illustrating the invention further and to assist a person skilled in the art with understanding the invention and are not meant to be construed as unduly limiting the reasonable scope of the invention.

The invention claimed is:

1. A plumbing connection hub, comprising:

a container having a continuous wall, a back wall integrally formed with the continuous wall, and an open front side;

a tubular drain outlet leading out of the container through an operatively lower portion of the wall, wherein the outlet is configured to be connectable to a sewage system of a house;

a looped flexible hose;

a first drain inlet leading into the container from the open front side via a tube fixed to the wall, wherein a center of an inner end of the inlet and a center of an inner end of the outlet are positioned vertically in-line to receive the looped flexible hose, and wherein the first drain inlet is integrally formed with the container;

a second drain inlet leading into the container through the back wall, wherein the second drain inlet is integrally formed with the container;

a first cross-sectionally u-shaped channel integrally formed with the container and configured to fit a cold water connection elbow pipe; and a second cross-sectionally u-shaped channel integrally formed with the container and configured to fit a warm water connection elbow pipe, wherein the cross-sectionally u-shaped channels extend along a width of the sidewall.

2. The plumbing connection hub of claim 1, wherein the first drain inlet is elbow shaped or straight.

3. The plumbing connection hub of claim 2, wherein the back wall comprises one or more inspection openings configured for inspection and maintenance of the first drain inlet and/or the outlet.

4. The plumbing connection hub of claim 1, further comprising a back plate configured for covering an unused open side, in use.

5. The plumbing connection hub of claim 1, wherein one end of the cold or warm water connection elbow pipe extends through a hole in the wall of the container and the other end of the cold or warm water connection elbow pipe extends towards an open side.

6. The plumbing connection hub of claim 1, wherein one end of the cold or warm water connection elbow pipe extends away from the wall and the other end of the cold or warm water connection elbow pipe extends towards an open side of the container.

7. The plumbing connection hub of claim 1, further comprising a stopper formation in each of the first and the second cross-sectionally u-shaped channels.

8. The plumbing connection hub of claim 1, wherein the container comprises a lid with holes defined therein for receiving piping or connections therethrough.

9. The plumbing connection hub of claim 1, wherein the container comprises a first lid with holes defined therein for receiving piping or connections therethrough and a second lid with no holes for closing the other open end through which no piping extends, in use.

10. The plumbing connection hub of claim 1, wherein at least one of a lid, back plate, or side walls comprises gripping formations thereon configured for gripping cement when built into a wall.

11. The plumbing connection hub of claim 8 further comprising complementary holes configured to receive screws for attaching the lid to the container.

12. The plumbing connection hub of claim 1, wherein the looped flexible hose is used instead of an s-trap, but provides a same function as does an s-trap.

13. The plumbing connection hub of claim 12, which does not comprise an s-trap.

* * * * *